US006443224B2

(12) United States Patent
Sasaki

(10) Patent No.: US 6,443,224 B2
(45) Date of Patent: Sep. 3, 2002

(54) PIPING STRUCTURE FOR HEAT EXCHANGER, PIPING JOINT BLOCK FOR HEAT EXCHANGER AND HEAT EXCHANGER WITH SAID JOINT BLOCK

(75) Inventor: Hironaka Sasaki, Ibaraki (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/862,061

(22) Filed: May 21, 2001

(30) Foreign Application Priority Data

May 22, 2000 (JP) ..... 2000-149293

(51) Int. Cl.[7] ..... F28F 9/04; F28D 7/06; B60D 1/62

(52) U.S. Cl. ..... 165/178; 285/62; 165/176

(58) Field of Search ..... 165/178, 176; 285/61, 62; 248/56, 49; 403/393, 394, 399, 403, 408.1, 84

(56) References Cited

U.S. PATENT DOCUMENTS 5,022,464 A * 6/1991 Aoki et al. ..... 165/176
5,477,919 A * 12/1995 Karube ..... 165/176
5,509,473 A * 4/1996 Tokutake ..... 165/178
5,526,876 A * 6/1996 Karube ..... 165/176
5,937,939 A * 8/1999 Inabe et al. ..... 165/178
5,941,304 A * 8/1999 Inaba et al. ..... 165/178
6,065,534 A * 5/2000 Sircar ..... 165/178

FOREIGN PATENT DOCUMENTS

JP 4-306492 3/1991

* cited by examiner

*Primary Examiner*—Henry Bennett
*Assistant Examiner*—Tho V Duong

(57) ABSTRACT

A first joint block 30 and a second joint block 40 are connected to an end of a refrigerant inlet pipe 6*a* and that of a refrigerant outlet pipe 6*b*, respectively. Both the joint blocks 30 and 40 are connected each other. A predetermined face of the first joint block 30 constitutes a first flange face 31, and a face of the second joint block 40 facing toward a direction different from the predetermined face constitutes a second flange face 41. At the end of a first external pipe 50*a* and that of a second external pipe 50*b*, flange members 51*a* and 51*b* are attached. When connecting these flange members, the first and second external pipes 50*a* and 50*b* are connected to the joint blocks 30 and 40 from different directions.

16 Claims, 4 Drawing Sheets

PIPING STRUCTURE FOR HEAT EXCHANGER, PIPING JOINT BLOCK FOR HEAT EXCHANGER AND HEAT EXCHANGER WITH SAID JOINT BLOCK

BACKGROUND OF THE INVENTION

1. Field of the Invention

The present invention relates to piping structure preferably used for connecting external pipes to a heat exchanger such as a condenser in a refrigeration system for car air-conditioners. It also relates to a piping joint block for a heat exchanger and a heat exchanger equipped with the joint block.

2. Description of Related Art

Japanese Patent Unexamined Laid-open Publication No. 4-306492 discloses a condenser for use in a refrigeration system for car air-conditioners. This condenser includes a pair of headers and a plurality of heat exchanging tubes disposed between the pair of headers with their opposite ends connected to the headers. The headers are provided with partitions to divide the plurality of heat exchanging tubes into a plurality of passes, whereby the refrigerant introduced into one of the headers through the refrigerant inlet port formed in the header flows through each pass in order, and is flowed out of the condenser through the refrigerant outlet port formed in the header.

In this condenser, a flange connection system using a joint block is employed for connecting the refrigerant inlet and outlet pipes, which are connected to the refrigerant inlet port and the refrigerant outlet port of the condenser body, respectively, to external pipes connected to a compressor, an expansion valve, etc. In detail, a single joint block is attached to the ends of the refrigerant inlet and outlet pipes, and an external piping flange member is attached to each end of the external pipes. Each external piping flange member is connected to the joint block with a screw in the state that the flange member is fitted on the flange face of the joint block, whereby the refrigerant inlet pipe and the refrigerant outlet pipe are connected to the first and second external pipes through the first and second communication passages formed in the joint block, respectively.

In this joint block, both openings of the communication passages, which is in fluid communication with the refrigerant inlet and outlet pipes, are formed on the same flange face so as to connect the first and second external pipes to the joint block from the same direction.

By the way, depending on a type of a car, it is sometimes required to connect the first and second external pipes to the joint block from different directions. In this case, there are the following problems. That is, it is required to form two flange faces facing toward different directions on the joint block, an opening of a first communication passage on one of the flange faces and an opening of a second communication passage on another flange face. However, in this case, different faces of the joint block constitutes flange faces and the communication passages to be formed in the joint block is complicated in shape, which increases difficulties in forming the joint block and the manufacturing cost.

SUMMARY OF THE INVENTION

An object of the present invention is to provide piping structure for a heat exchanger, which enables refrigerant inlet and outlet external pipes to be connected from different directions and can reduce the manufacturing cost.

Another object of the present invention is to provide a joint block for a heat exchanger, which is suitably used for the aforementioned piping structure.

Still another object of the present invention is to provide a heat exchanger equipped with the aforementioned joint block.

According to a first aspect of the present invention, a piping structure for a heat exchanger includes a refrigerant inlet pipe to be connected to the heat exchanger, a first joint block connected to an end of the refrigerant inlet pipe, a refrigerant outlet pipe to be connected to the heat exchanger, a second joint block connected to an end of the refrigerant outlet pipe, a first external pipe, a first flange member connected to an end of the first external pipe for connecting the first external pipe to the first joint block, a second external pipe, and a second flange member connected to an end of the second external pipe for connecting the second external pipe to the second joint block. The first joint block has a first engaging portion and a first flange face for connecting the first flange member, and the second joint block has a second engaging portion corresponding to the first engaging portion and a second flange face for connecting the second flange member. The first and second joint blocks are connected with each other in a state where the first engaging portion is engaged with the second engaging portion, and a facing direction of the first flange face is different from that of the second flange face in a state where the first joint block and the second joint block are connected each other. Thus, the first external pipe and the second external pipe are connected to the first joint block and the second joint block, respectively, from different directions.

In this piping structure, since the facing direction of the second flange face of the second joint block is different from that of the first flange face of the first joint block, it is possible to connect the flange member of the first external pipe and that of the second external pipe to the first flange face and the second flange face, respectively, from different directions with no difficulty. Furthermore, both the joint blocks can be positioned by simply engaging the first engaging portion of the first joint block with the second engaging portion of the second joint block, which enables an easy connection of the joint blocks.

It is preferable that one of the first engaging portion and the second engaging portion is an engaging dented portion and the other thereof is an engaging member to be engaged with the engaging dented portion, and wherein the first joint block and the second joint block are connected each other in a positioned manner with the engaging member engaged with the engaging dented portion. In this case, both the joint blocks can be positioned easily.

According to a second aspect of the present invention, a joint block for a heat exchanger includes a first joint block to be connected to an end of a refrigerant inlet pipe connected to the heat exchanger and a second joint block to be connected to an end of a refrigerant outlet pipe connected to the heat exchanger. The first joint block has a first engaging portion and a first flange face for connecting a first flange member connected to a first external pipe, the second joint block has a second engaging portion corresponding to the first engaging portion and a second flange face for connecting a second flange member connected to a second external pipe. The first and second joint blocks are connected each other in a state where the first engaging portion is engaged with the second engaging portion, and a facing direction of the first flange face is different from that of the second flange face when the first joint block and the second joint block are connected each other. Thus, the first external pipe and the second external pipe are connected to the first joint block and the second joint block, respectively, from different directions.

In this joint block, it is possible to separately manufacture the first and second joint blocks each having a single flange face and a single communication passage. Accordingly, it is easy to manufacture the joint blocks as compared with manufacturing a single joint block having two flange faces and two communication passages, resulting in a reduced manufacturing cost.

According to a third aspect of the present invention, a heat exchanger with a piping joint block includes a heat exchanger body, a refrigerant inlet pipe with one end communicated with the heat exchanger for introducing refrigerant into the heat exchanger, a refrigerant outlet pipe with one end communicated with the heat exchanger for discharging refrigerant from the heat exchanger, a first joint block connected to the other end of the refrigerant inlet pipe, and a second joint block connected to the other end of the refrigerant outlet pipe. The first joint block has a first engaging portion and a first flange face for connecting a first flange member connected to a first external pipe, the second joint block has a second engaging portion corresponding to the first engaging portion and a second flange face for connecting a second flange member connected to a second external pipe, and the first and second joint blocks are connected with each other in a state where the first engaging portion is engaged with the second engaging portion. The facing direction of the first flange face is different from that of the second flange face when the first joint block and the second joint block are connected each other, whereby the first external pipe and the second external pipe are connected to the first joint block and the second joint block, respectively, from different directions.

In this heat exchanger, since the facing direction of the second flange face of the second joint block is different from that of the first flange face of the first joint block, it is possible to connect the flange member of the first external pipe and that of the second external pipe to the first flange face and the second flange face, respectively, from different directions with no difficulty.

Other objects and the features will be apparent from the following detailed description of the present invention with reference to the attached drawings.

BRIEF DESCRIPTION OF THE DRAWINGS

The present invention will be more fully described and better understood from the following description, taken with the appended drawings, in which.

DETAILED DESCRIPTION OF THE PREFERRED EMBODIMENTS

Figure 1:
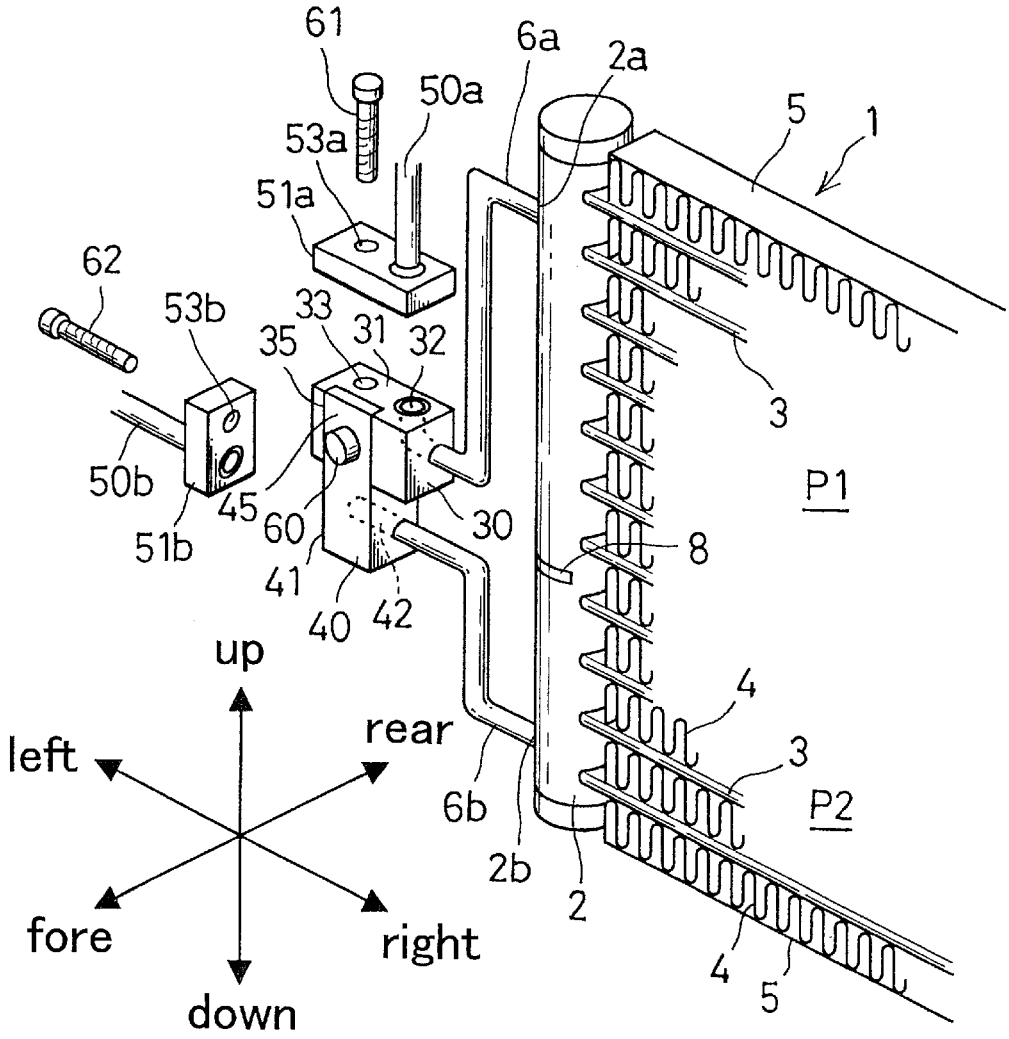
FIG. 1 is a perspective view showing a piping structure according to an embodiment of the present invention applied to a condenser.

FIG. 1 shows piping structure of a condenser for use in a car air-conditioner which is an embodiment of the present invention.

For easy understanding of the present invention, in the following explanation, the front side, the rear side, the right side, the left side, the upper side and the lower side of FIG. 1 will be denoted as "fore direction," "rear direction," "right direction," "left direction," "upper direction," and "lower direction," respectively.

As shown in FIG. 1, this condenser 1 is equipped with a refrigerant inlet pipe 6*a* for introducing a gaseous refrigerant and a refrigerant outlet pipe 6*b* for discharging a liquefied refrigerant. A first joint block 30 is provided at an end of the refrigerant inlet pipe 6*a*, and a second joint block 40 is provided at an end of the refrigerant outlet pipe 6*b*.

The condenser 1 includes a pair of right and left headers 2 and 2 spaced apart from each other and disposed vertically, a plurality of flat heat exchanging tubes 3 disposed horizontally between the headers 2 with the opposite ends thereof connected to the headers, and corrugated fins 4 disposed between the adjacent heat exchanging tubes 3 and on the outermost heat exchanging tube 3. On the outermost corrugated fin 4, a belt-shaped side plate 5 for protecting the outermost corrugated fin 4 is provided.

The left header 2 is provided with a refrigerant inlet port 2*a* and a refrigerant outlet port 2*b* at the upper side portion and the lower side portion of the left header 2, respectively. Furthermore, the left header 2 is provided with a partition 8 which divides the inside of the left header 2 in the longitudinal direction to thereby divide the aforementioned plurality of heat exchanging tubes 3 into two passes P1 and P2.

In this condenser 1, the refrigerant flowed into the left header 2 via the refrigerant inlet port 2*a* passes rightward through the first pass P1 constituted by a plurality of heat exchanging tubes 3 located above the partition 8 to be flowed into the right header 2 (not shown). The refrigerant flowed into the right header 2 (not shown) makes a U-turn therein and passes leftward through the second pass P2 constituted by a plurality of heat exchanging tubes 3 located below the partition 8 to be flowed out of the condenser 1 via the refrigerant outlet port 2*b*.

One end of the refrigerant inlet pipe 6*a* is connected to the refrigerant inlet port 2*a* of the condenser 1 by brazing, etc. On the other hand, one end of the refrigerant outlet pipe 6*b* is connected to the refrigerant outlet port 2*b* by brazing, etc. Furthermore, the other ends of the refrigerant inlet and outlet pipes 6*a* and 6*b* are gathered at the predetermined location on the left-hand side of the left header 2.

Figure 2:
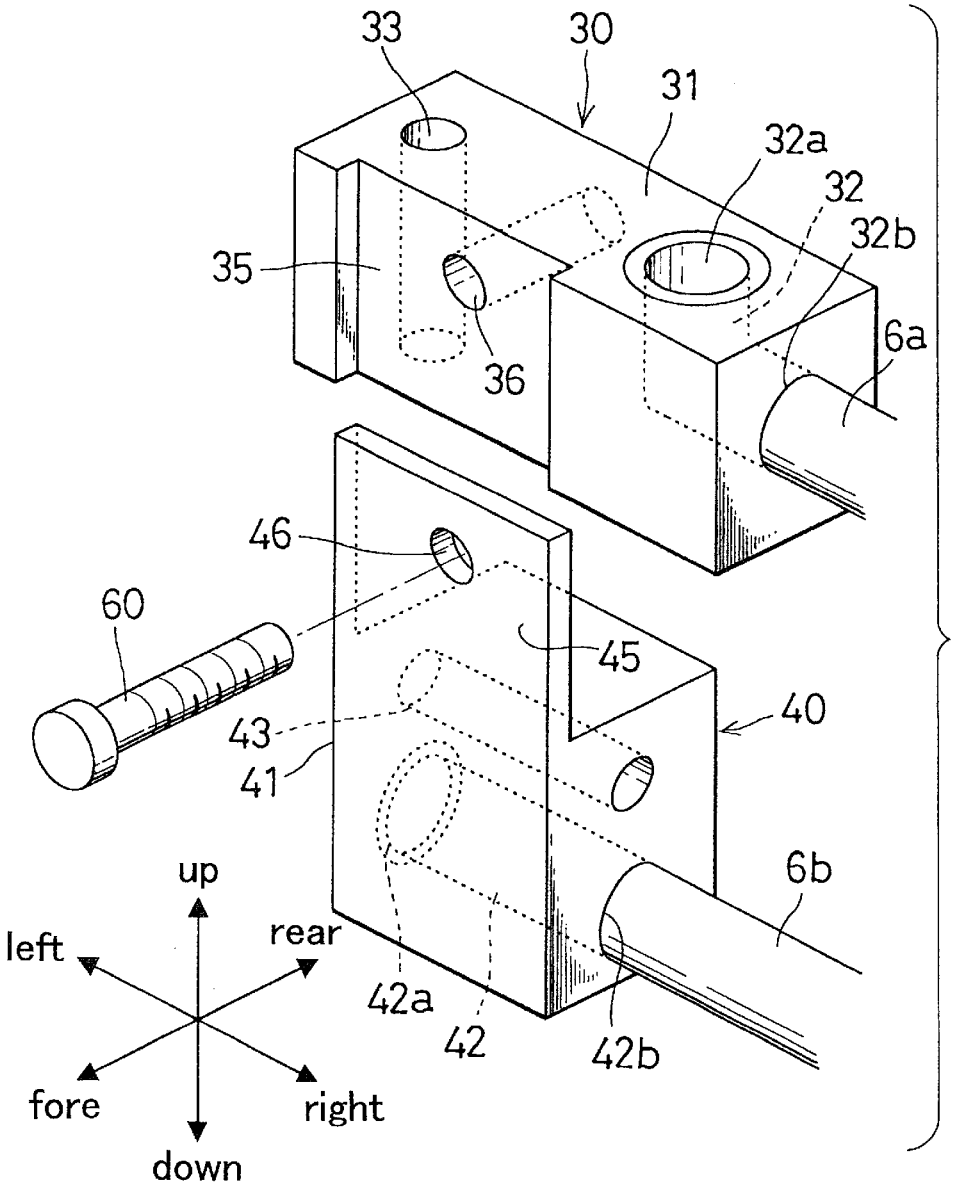
FIG. 2 is an exploded enlarged perspective view showing the joint block used for the aforementioned piping structure.
Figure 3:
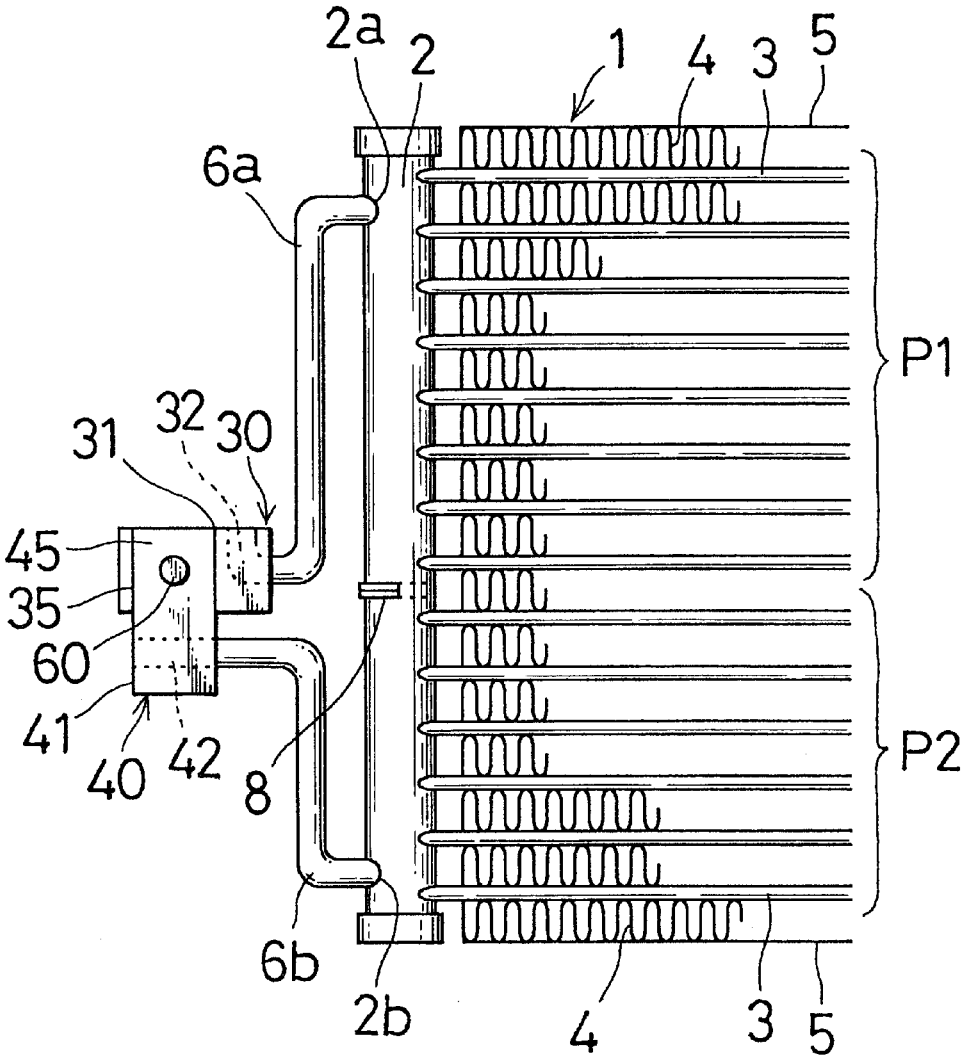
FIG. 3 is a partial front view showing the condenser equipped with the aforementioned joint block.

The first joint block 30 provided at the other end (tip) of the refrigerant inlet pipe 6*a* is a formed article made of aluminum or its alloy. In the first joint block 30, the upper surface constitutes a first flange face 31 for connecting a first external pipe flange 51*a* which will be mentioned later. As shown in FIG. 2, in this first joint block 30, an L-shaped first communication passage 32 is provided at the right-hand side part of the joint block. The first communication passage 32 includes a first opening 32*a* formed at the rightward portion of the first flange face 31 and a second opening 32*b* formed at the center of the right-hand side of the block 30. To this second opening 32*b* of the first communication passage 32, the end (tip) of the aforementioned refrigerant inlet pipe 6*a* is connected. In this embodiment, the first joint block 30 is fixed to the refrigerant inlet pipe 6*a* by welding or forcible insertion, and then the inlet pipe 6*a* with the joint block 30 is brazed to the condenser 1. Furthermore, a screw bore 33 is formed at the leftward side of the first flange face 31 of the first joint block 30.

At the leftward portion of the front face of the first joint block 30, an engaging cut-out portion 35 as the first engaging portion is formed so as to extend in the up-and-down direction, and a screw bore 36 is formed at the bottom of the engaging cut-out portion 35.

On the other hand, the second joint block 40 provided at the other end(tip) of the refrigerant outlet pipe 6*b* is a formed article made of aluminum or its alloy likewise the first joint block 30. In the second joint block 40, the left-hand side surface constitutes a second flange face 41 for connecting a second external pipe flange 51*b* which will be mentioned later. At the lower portion of the second joint block 40, a straight second communication passage 42 is formed. The second communication passage 42 includes a first opening 42*a* formed at the lower portion of the second flange face 41 and a second opening 42*b* formed at the lower portion of the right-hand side surface of the joint block 40. To the second opening 42*b*, the aforementioned refrigerant outlet pipe 6*b* is connected. In this embodiment, the second joint block 40 is fixed to the refrigerant outlet pipe 6*b* by welding or forcible insertion, and then the outlet pipe 6*b* with the joint block 40 is brazed to the condenser A screw bore 43 is formed at the upper portion of the second flange face 41 of the second joint block 40.

At the upper front edge of the second joint block 40, an upwardly protruding engaging ledge 45 as the second engaging portion to be fitted in the engaging cut-out portion 35 is integrally provided. At the center of this engaging ledge 45, a screw insertion aperture 46 is formed.

The engaging ledge 45 is fitted in the engaging cut-out portion 35 in a state where the upper surface of the second joint block 40 is fitted to the lower surface of the first joint block 30. In this state, a screw or bolt 60 is inserted in the screw insertion aperture 46 of the engaging ledge 45 and engaged in the screw bore 36 formed at the engaging cut-out portion 35, whereby the first joint block 30 and the second joint block 40 are fixed in a predetermined positioned manner.

Connecting the first and second joint blocks 30 and 40 may be performed before brazing the refrigerant inlet and outlet pipes 6*a* and 6*b* to the condenser 1, or alternatively may be performed after brazing the refrigerant inlet and outlet pipes 6*a* and 6*b* to the condenser 1.

On the other hand, as shown in FIG. 1, at the end (tip) of the first external pipe 50*a*, a flange 51*a* corresponding to the first flange face 31 of the first joint block 30 is fixed. The flange 51*a* is provided with a screw insertion aperture 53*a* corresponding to the aforementioned screw bore 33 of the first joint block 30.

In the state where the end opening of the first external pipe 50*a* is aligned with the first opening 32*a* of the first communication passage 32 of the first joint block 30, the flange 51*a* of the first external pipe 50*a* is fitted on the flange face 31 of the first joint block 30. Then, in this state, inserting into the screw insertion aperture 53*a* of the first external pipe flange 51*a*, the screw or bolt 61 is screwed into the screw bore 33 of the first joint block 30 to thereby perform the flange connection of the first external pipe flange 51*a* and the first joint block 30. As a result, the first external pipe 50*a* becomes in fluid communication with the refrigerant inlet pipe 6*a* via the first communication passage 32.

Furthermore, at the tip end of the second external pipe 50*b*, a flange 51*b* corresponding to the second flange face 41 of the second joint block 40 is fixed. The flange 51*b* is provided with a screw insertion aperture 53*b* corresponding to the aforementioned screw bore 43 of the second joint block 40.

In the state where the tip end of the second external pipe 50*b* is aligned with the first opening 42*a* of the second communication passage 42 of the second joint block 40, the flange 51*b* of the second external pipe 50*b* is fitted on the flange face 41 of the second joint block 40. Then, in this state, inserting into the screw insertion aperture 50*b* of the second external pipe flange 51*b*, the screw or bolt 62 is screwed into the screw bore 43 of the second joint block 40 to thereby perform the flange connection of the first external pipe flange 51*b* and the second joint block 40. As a result, the second external pipe 50*b* becomes in fluid communication with the refrigerant outlet pipe 6*b* via the second communication passage 42.

In the aforementioned piping structure, the refrigerant supplied through the first external pipe 50*a* is introduced into the condenser 1 via the first communication passage 32 of the first joint block 30 and the refrigerant inlet pipe 6*a*. On the other hand, the refrigerant flowed out of the condenser 1 is introduced into the second external pipe 50*b* via the refrigerant outlet pipe 6*b* and the second communication passage 42 of the second joint block 40.

As mentioned above, according to the piping structure of the condenser of this embodiment, the first joint block 30 having the first flange face 31 constituted by the upper surface of the block is fixed to the tip end of the refrigerant inlet pipe 6*a*, and the second joint block 40 having the second flange face 41 constituted by the left-hand side surface is fixed to the tip end of the refrigerant outlet pipe 6*b*. Thereafter, both the joint blocks 30 and 40 are fixed each other with the screw or bolt 60. Accordingly, by performing a flange connection between the flange 51*a* of the first external pipe 50*a* drawn from the above side and the flange face 31 of the first joint block 30 and between the flange 51*b* of the second external pipe 50*b* drawn from the left side and the flange face 41 of the second joint block 40, the first and second external pipes 50*a* and 50*b* which are drawn from different directions, the above side and the left side, can be connected with no difficulty.

Furthermore, since both the joint blocks 30 and 40 are integrally connected with the screw or bolt 60, these blocks 30 and 40 are supported by the two members, the refrigerant inlet pipe 6*a* and the refrigerant outlet pipe 6*b*, with sufficient strength. Therefore, it is not necessary to support these joint blocks 30 and 40 by using reinforcing brackets or the like, resulting in a reduced number of parts, which enables an easier piping assembly and a cost reduction.

Furthermore, in this embodiment, the engaging ledge 45 as the second engaging portion of the second joint block 40 is fitted in the engaging cut-out portion 35 as the first engaging portion 35 so as to position both the joint blocks 30 and 40, the positioning of both the joint blocks 30 and 40 can be performed easily, resulting in an easier assembly operation.

Furthermore, in this embodiment, since the first and second joint blocks 30 and 40 are connected each other, it becomes possible to assuredly gather the tip ends of the refrigerant inlet and outlet pipes 6*a* and 6*b*, resulting in a compact piping structure.

In this embodiment, the upper surface of the first joint block 30 constitutes the first flange face 31, and the left side surface of the second joint block 40 constitutes the second flange face 41. However, the present invention does not limit to the aforementioned structure, and each of the first and second flange surfaces 31 and 41 may be constituted by another surface of the blocks 30 and 40. In other words, the present invention allows various design changes, provided that the facing direction of the first flange face of the first joint block 30 is different from that of the second flange face of the second joint block 40.

Figure 4A:
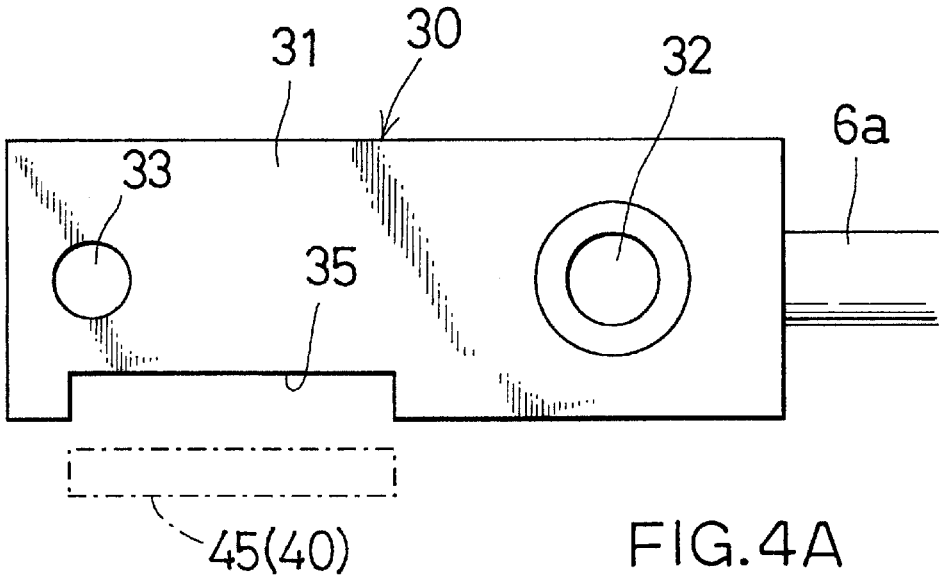
FIG. 4A is an enlarged plan view of a first joint block constituting the aforementioned joint block.
Figure 4B:
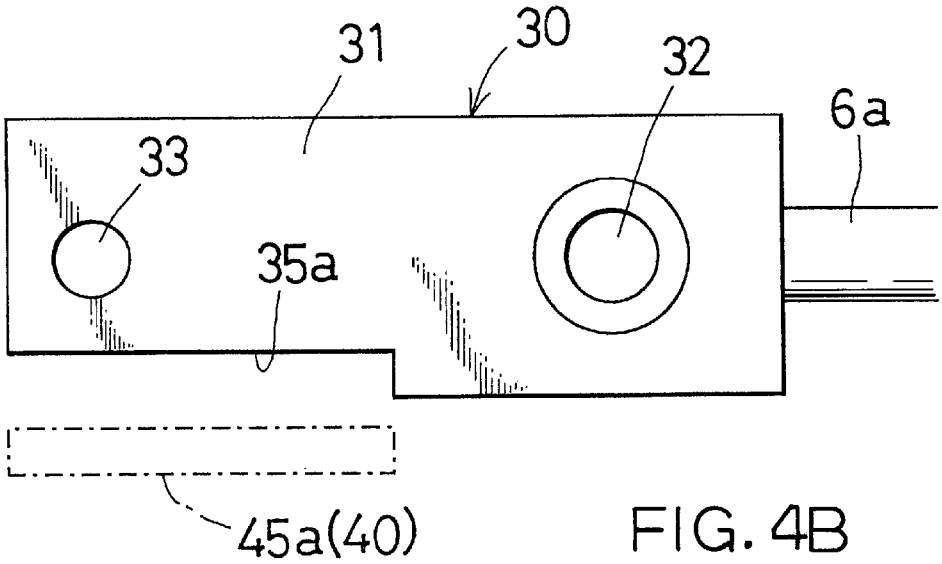
FIG. 4B is an enlarged plan view showing a modification of the aforementioned joint block.

In the aforementioned embodiment, as shown in FIG. 4A, the first engaging portion and the second engaging portion are constituted by the engaging cut-out portion 35 and engaging ledge 45, respectively. However, in the present invention, the structure of the first and second engaging portions are not limited to the above. In the present invention, provided that the first engaging portion and the second engaging portion can be positioned when engaged with each other, the present invention allows various design changes. For example, as shown in FIG. 4B, a cut-out stepped portion 35*a* as the first engaging portion may be formed by vertically cutting out a predetermined width of the front left-hand side portion of the first joint block 30. On the other hand, an upwardly protruding engaging ledge 45*a* as the second engaging portion corresponding to the aforementioned cut-out stepped portion 35*a* may be formed to the second joint block 40. Then, the engaging ledge 45*a* of the second joint block 40 may be engaged with the cut-out stepped portion 35*a* of the first joint block 30.

Furthermore, in the aforementioned embodiment, although the present invention is applied to piping structure for a condenser, the present invention is not limited to this, and may be applied to any piping structure for various heat exchangers including an evaporator.

In the piping structure for a heat exchanger according to the present invention, since the facing direction of the second flange face of the second joint block is different from that of the first flange face of the first joint block, the flange of the first external pipe and that of the second external pipe can be easily connected to the first flange face and the second flange face from different directions, respectively. Furthermore, the first and second joint blocks are integrally connected each other and supported by two members, the refrigerant inlet pipe and the refrigerant outlet pipe, with sufficient strength, any support member for supporting the joint blocks are not required, resulting in a decreased number of parts and a cost reduction. Furthermore, the positioning of both the joint blocks can be performed by simply engaging the first and second engaging portions formed on the first and second joint blocks, respectively. Therefore, the positioning of the joint blocks can be performed easily, resulting in an easy assembly operation including a pipe connection operation. Furthermore, since the positioning of both the joint blocks can be performed by engaging the first engaging portion of the first joint block with the second engaging portion of the second joint block, the positioning can be performed easily.

In the piping joint block for a heat exchanger according to the present invention, since the first and second joint blocks each having a single flange face and a single communication passage can be manufactured separately, the manufacturing operation can be performed easily as compared with the case where a single joint block having two flange faces and two communication passages is manufactured, resulting in a reduced manufacturing cost.

In the heat exchanger according to the present invention, the facing direction of the second flange face of the second joint block is different from that of the first flange face of the first joint block. Therefore, the flange of the first external pipe and that of the second external pipe can be connected to the first and second flange faces from different directions with no difficulty.

The terms and descriptions in this specification are used only for explanatory purposes and the present invention is not limited to these terms and descriptions. It should be appreciated that there are many modifications and substitutions without departing from the spirit and the scope of the present invention which is defined by the appended claims.

This application claims priority to Japanese Patent Application No. 2000-149293 filed on May 22, 2000, the disclosure of which is incorporated by reference in its entirety.

What is claimed is:

1. Piping structure for a heat exchanger, comprising:

a refrigerant inlet pipe to be connected to said heat exchanger;

a first joint block connected to an end of said refrigerant inlet pipe;

a refrigerant outlet pipe to be connected to said heat exchanger;

a second joint block connected to an end of said refrigerant outlet pipe;

a first external pipe;

a first flange member connected to an end of said first external pipe for connecting said first external pipe to said first joint block;

a second external pipe; and a second flange member connected to an end of said second external pipe for connecting said second external pipe to said second joint block;

wherein said first joint block has a first engaging portion and a first flange face for connecting said first flange member, wherein said second joint block has a second engaging portion corresponding to said first engaging portion and a second flange face for connecting said second flange member, wherein said first and second joint blocks are connected with each other in a state where said first engaging portion is engaged with said second engaging portion, and wherein a facing direction of said first flange face is different from that of said second flange face in a state where said first joint block and said second joint block are connected each other, whereby said first external pipe and said second external pipe are connected to said first joint block and said second joint block, respectively, from different directions.

2. The piping structure for a heat exchanger as recited in claim 1, wherein one of said first engaging portion and said second engaging portion is an engaging dented portion and the other thereof is an engaging member to be engaged with said engaging dented portion, and wherein said first joint block and said second joint block are connected each other in a positioned manner with said engaging member engaged with said engaging dented portion.

3. The piping structure for a heat exchanger as recited in claim 1, wherein said first joint block and said second joint block are connected each other by means of a tightening member.

4. The piping structure for a heat exchanger as recited in claim 3, wherein said tightening member is a screw.

5. The piping structure for a heat exchanger as recited in claim 1, wherein said first joint block and said second joint block are made of aluminum or its alloy, respectively.

6. A joint block for a heat exchanger, comprising:

a first joint block to be connected to an end of a refrigerant inlet pipe connected to said heat exchanger; and a second joint block to be connected to an end of a refrigerant outlet pipe connected to said heat exchanger;

wherein said first joint block has a first engaging portion and a first flange face for connecting a first flange member connected to a first external pipe, wherein said second joint block has a second engaging portion corresponding to said first engaging portion and a second flange face for connecting a second flange member connected to a second external pipe, wherein said first and second joint blocks are connected each other in a state where said first engaging portion is engaged with said second engaging portion, and wherein a facing direction of said first flange face is different from that of said second flange face when said first joint block and said second joint block are connected each other, whereby said first external pipe and said second external pipe are connected to said first joint block and said second joint block, respectively, from different directions.

7. The joint block for a heat exchanger as recited in claim 6, wherein one of said first engaging portion and said second engaging portion is an engaging dented portion and the other thereof is an engaging member to be engaged with said engaging dented portion, and wherein said first joint block and said second joint block are positioned and connected each other with said engaging member engaged with said engaging dented portion.

8. The joint block for a heat exchanger as recited in claim 6, wherein said first joint block and said second joint block are connected each other by means of a tightening member.

9. The joint block for a heat exchanger as recited in claim 8, wherein said tightening member is a screw.

10. The joint block for a heat exchanger as recited in claim 6, wherein said first joint block and said second joint block are made of aluminum or its alloy, respectively.

11. A heat exchanger with a piping joint block, comprising:

a heat exchanger body;

a refrigerant inlet pipe with one end communicated with said heat exchanger for introducing a refrigerant into said heat exchanger;

a refrigerant outlet pipe with one end communicated with said heat exchanger for discharging a refrigerant from said heat exchanger;

a first joint block connected to the other end of said refrigerant inlet pipe; and a second joint block connected to the other end of said refrigerant outlet pipe;

wherein said first joint block has a first engaging portion and a first flange face for connecting a first flange member connected to a first external pipe, wherein said second joint block has a second engaging portion corresponding to said first engaging portion and a second flange face for connecting a second flange member connected to a second external pipe, wherein said first and second joint blocks are connected with each other in a state where said first engaging portion is engaged with said second engaging portion, and wherein a facing direction of said first flange face is different from that of said second flange face when said first joint block and said second joint block are connected each other, whereby said first external pipe and said second external pipe are connected to said first joint block and said second joint block, respectively, from different directions.

12. The heat exchanger with a piping joint block as recited in claim 11, wherein said heat exchanger comprises a pair of headers and a plurality of heat exchanging tubes whose opposite ends are communicate d with said headers.

13. The heat exchanger with a piping joint block as recited in claim 11, wherein one of said first engaging portion and said second engaging portion is an engaging dented portion and the other thereof is an engaging member to be engaged with said engaging dented portion, and wherein said first joint block and said second joint block are connected each other in a positioned manner with said engaging member engaged with said engaging dented portion.

14. The heat exchanger with a piping joint block as recited in claim 11, wherein said first joint block and said second joint block are connected each other by means of a tightening member.

15. The heat exchanger with a piping joint block as recited in claim 14, wherein said tightening member is a screw.

16. The heat exchanger with a piping joint block as recited in claim 11, wherein said first joint block and said second joint block are made of aluminum or its alloy, respectively.

* * * * *

UNITED STATES PATENT AND TRADEMARK OFFICE

CERTIFICATE OF CORRECTION

PATENT NO. : 6,443,224 B2
DATED : September 3, 2002
INVENTOR(S) : Hironaka Sasaki It is certified that error appears in the above-identified patent and that said Letters Patent is hereby corrected as shown below:

Column 2,
Line 23, delete “communicate d” and insert -- communicated --

Signed and Sealed this

Eighteenth Day of February, 2003

JAMES E. ROGAN
*Director of the United States Patent and Trademark Office*